US006802237B1

(12) United States Patent
Jones et al.

(10) Patent No.: US 6,802,237 B1
(45) Date of Patent: Oct. 12, 2004

(54) SYSTEM AND METHOD FOR NEUTRALIZATION OF MINES USING ROBOTICS AND PENETRATING RODS

(75) Inventors: W. Steve Jones, Panama City Beach, FL (US); Charles D. Woodring, Bellefonte, PA (US); Michael E. Szostkiewicz, Plant City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/429,332

(22) Filed: Apr. 28, 2003

(51) Int. Cl.[7] ..... B63G 7/02
(52) U.S. Cl. ..... 89/1.13; 102/402
(58) Field of Search ..... 89/1.13; 102/402, 102/403

(56) References Cited

U.S. PATENT DOCUMENTS 5,448,936 A * 9/1995 Turner ..... 89/1.13
5,988,038 A * 11/1999 Feintuch ..... 89/1.13
6,405,627 B1 * 6/2002 Anderson ..... 89/1.13

FOREIGN PATENT DOCUMENTS

DE 33 35 464 A1 * 4/1985 ..... 89/1.13

* cited by examiner

*Primary Examiner*—Stephen M. Johnson
(74) *Attorney, Agent, or Firm*—James T. Shepherd; Donald G. Peck

(57) ABSTRACT

A system and method to autonomously neutralize mines has a tracked crawler vehicle having a sealed housing, power source, and motor driven track assemblies on opposite sides of the housing. A control/communications module in the housing has a GPS processing receiver section connected to a GPS antenna that extends upwardly to receive GPS signals and generate first control signals. A gun mechanism in the housing is connected to control/communications module and has a breech assembly connected to a gun barrel extending and aiming downwardly through a bottom side of the housing toward a surface beneath the housing. Penetrating rods in the gun mechanism are fired through the gun barrel penetrating the surface and a mine. The mine is neutralized by flooding the mine with ambient water or otherwise disrupting the firing or explosive train including detonators, detonating cord, and/or the electrical continuity of components the mine.

23 Claims, 4 Drawing Sheets

SYSTEM AND METHOD FOR NEUTRALIZATION OF MINES USING ROBOTICS AND PENETRATING RODS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to mine countermeasures. More particularly, this invention is to a system to neutralize mines on land and under water using a robotic vehicle and penetrating rods to flood and/or disrupt the explosive or firing train of a mine.

The current methods of locating and clearing mines include various systems on Avenger-class Minesweepers, Osprey-class Mine hunters, helicopter assets, divers, and marine mammals. These methods are effective; however, they stand the chance of placing people, animals and valuable national assets in unnecessary danger, especially where divers are used in clearing operations.

Some rocket propelling and mechanical systems have been used to remotely deploy and detonate elongated line charges to clear a lane across a mined area. However, these systems can be unreliable since the line charges do not always go where they are intended to and can create gaps having unexploded mines. Furthermore, handling, deploying and detonating the explosive line charges is not only hazardous but immediately alerts others to the clearing activity and may attract unwanted attention.

Thus, in accordance with this inventive concept, a need has been recognized in the state of the art for an autonomous method and system for neutralizing mines underwater, in shallow water and very shallow water adjacent a shoreline by firing penetrating rods into the mines to flood them or disrupt their firing or explosive trains.

OBJECTS AND SUMMARY OF THE INVENTION

Another object of the invention is to provide an autonomous method and system to neutralize mines by firing penetrating rods into mines.

An object of the invention is to provide a method and autonomous system to neutralize mines by flooding them and/or mechanically disrupting their explosive or firing trains.

Another object of the invention is to provide an autonomous method and system to neutralize mines in an approach lane that does not expose personnel to danger.

Another object of the invention is to provide an autonomous method and system to neutralize mines underwater that reduces the possibility of alerting others to its presence.

Another object of the invention is to provide a cost effective autonomous method and system to neutralize mines underwater that is quickly completed in a single procedure.

Another object of the invention is to provide an autonomous method and system to neutralize-mines underwater using a tracked robotic vehicle having sensors for location of mines on top of and buried in soil, sand, and marine sediment.

Another object of the invention is to provide a cost effective autonomous method and system to disable and neutralize mines underwater using a robotic vehicle firing rod-like penetrating darts through soil, sand, and/or marine sediment.

Another object of the invention is to provide an autonomous method and autonomous system to neutralize mines underwater using a robotic vehicle firing penetrating darts to disable mines and retrieving the disabled mines for inspection.

Another object of the invention is to provide a cost effective autonomous method and system to neutralize mines using liquid bipropellant in a gun mechanism firing penetrating rod-like projectiles.

Another object of the invention is to provide an autonomous method and autonomous system to neutralize mines from underwater, through shallow water, and into very shallow water without subjecting personnel to danger or creating undue noise.

These and other objects of the invention will become more readily apparent from the ensuing specification when taken in conjunction with the appended claims.

Accordingly, the present invention is to an autonomous system and method for neutralizing mines to avoid exposure of personnel to this extremely dangerous activity. A tracked crawler vehicle of the system has a sealed housing, power source, and motor driven track assemblies on opposite sides of the housing. A control/communications module in the housing has a GPS processing receiver section connected to a GPS antenna that extends upwardly to receive GPS signals and generate first control signals. A gun mechanism in the housing is connected to control/communications module and has a breech assembly connected to a gun barrel extending and aiming downwardly through a bottom side of the housing toward a surface beneath the housing. Penetrating rods in the gun mechanism are fired through the gun barrel penetrating the surface and a mine. The mine is neutralized by flooding the mine with ambient water or otherwise disrupting the firing or explosive train including detonators, detonating cord, and/or the electrical continuity of components the mine. The method calls for generating first control signals from GPS signals on a GPS antenna coupled to a GPS processing receiver section of a control/communications module and for generating second control signals from a computer of the control/communications module. The control/communications module is in a tracked crawler vehicle having a sealed housing, power source, and motors driving track assemblies on opposite sides of the housing. Connecting responsive amounts of power from the power source to the motors with a motor control unit connected to receive the first and second control signals from the control/communications module assures steering and propelling of the tracked crawler vehicle by the first control signals from the control/communications module. Locating a mine beneath a topographical surface with acoustic signals penetrating beneath the surface allows maneuvering the tracked crawler vehicle to aim a gun barrel of a gun mechanism extending through a bottom side of the housing toward the surface and the mine. Firing at least one penetrating rod through the gun barrel and penetrating the surface and the mine with the penetrating rod assures neutralizing the mine.

DESCRIPTION OF THE PREFERRED EMBODIMENTS

Figure 1:
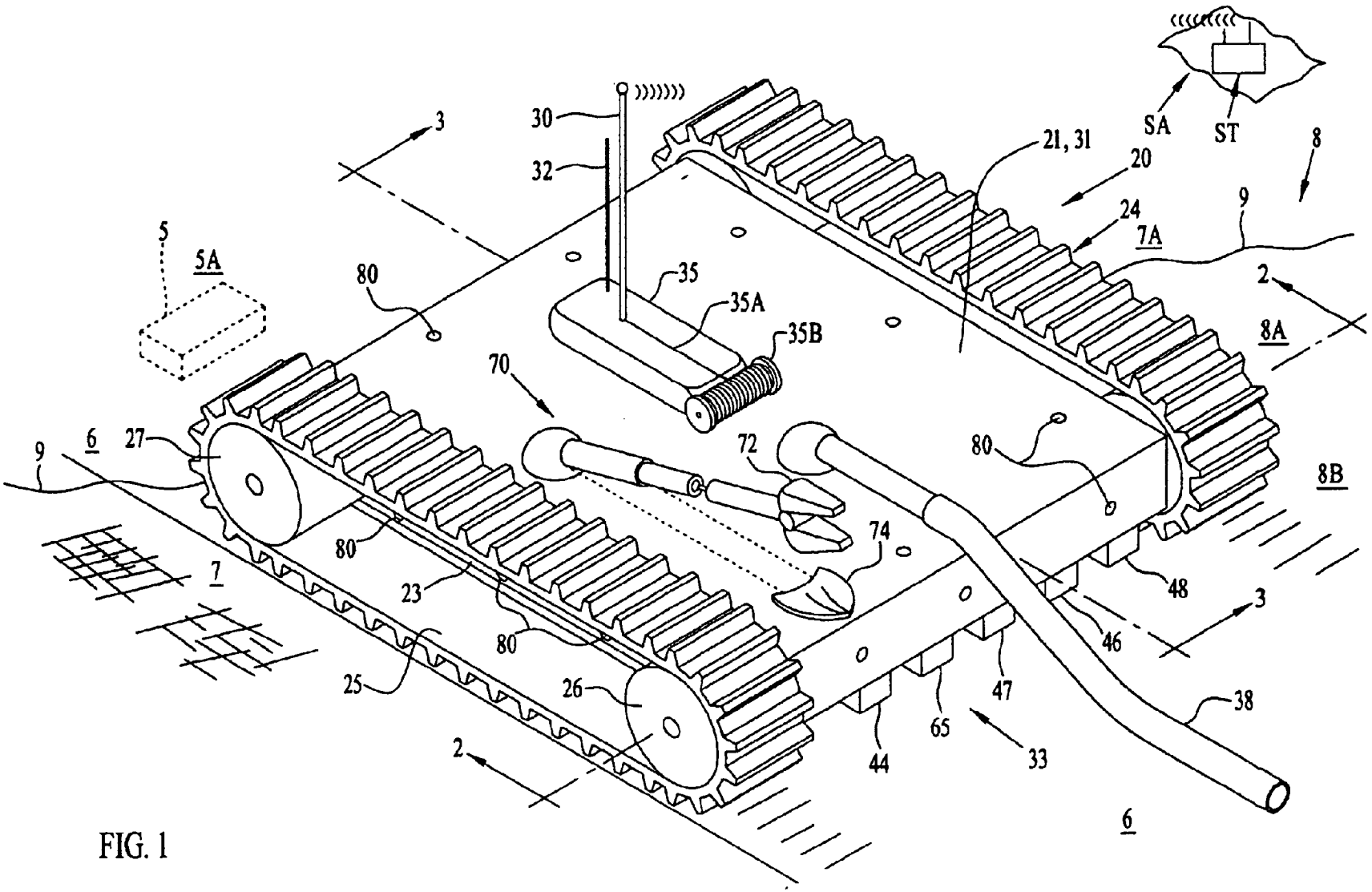
FIG. 1 is a schematic isometric view of the autonomous tracked system of the invention for neutralizing mines in an area extending from deep water, through shallower water including the surf zone, and onto land, such as a beach.
Figure 2:
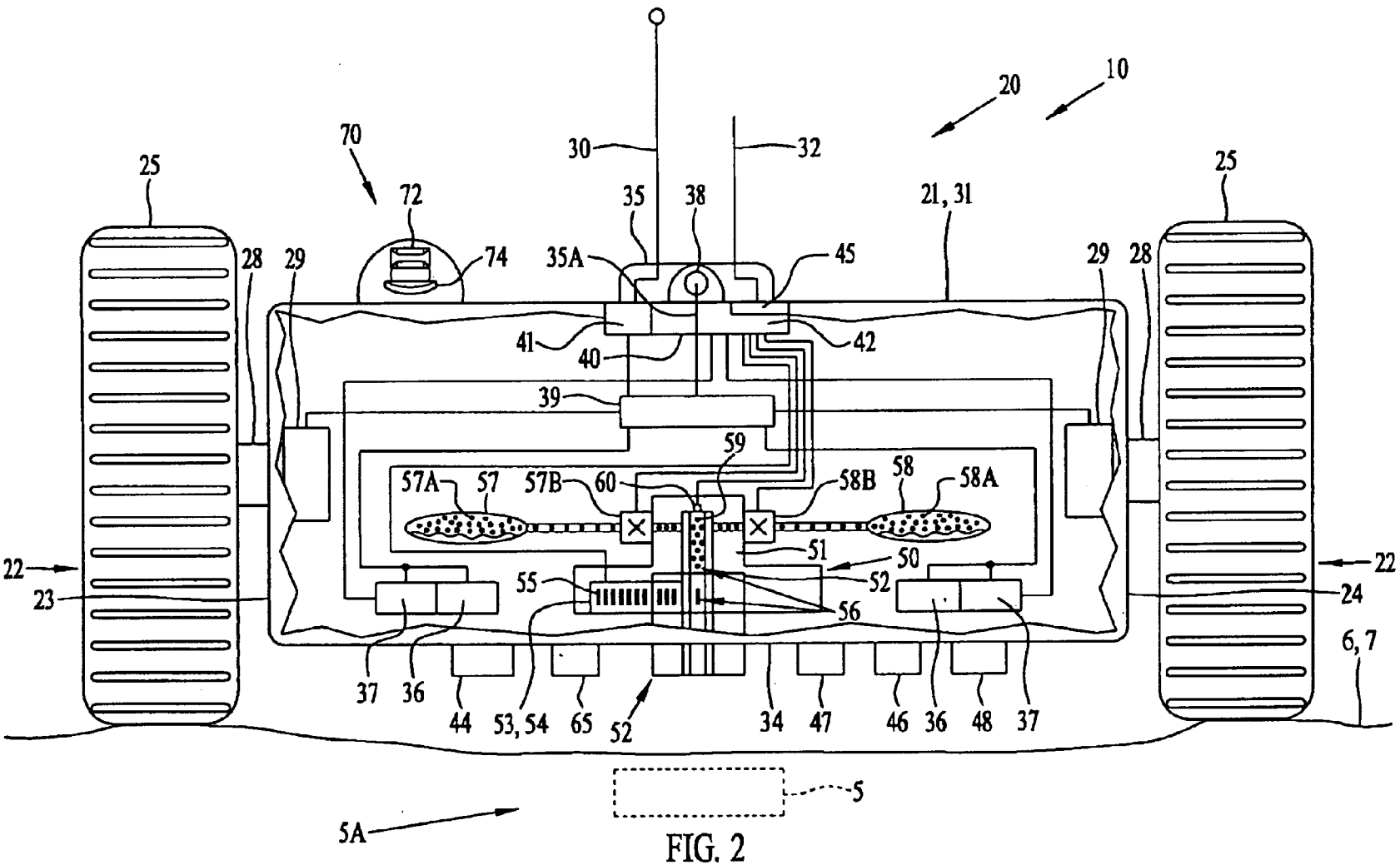
FIG. 2 is a cross-sectional schematic front view of the autonomous tracked neutralization system taken generally along line 2—2 in FIG. 1 showing some constituents for locating and disabling mines including a gun mechanism for firing penetrating rods through soil, sand, and/or marine sediment to neutralize mines.
Figure 3:
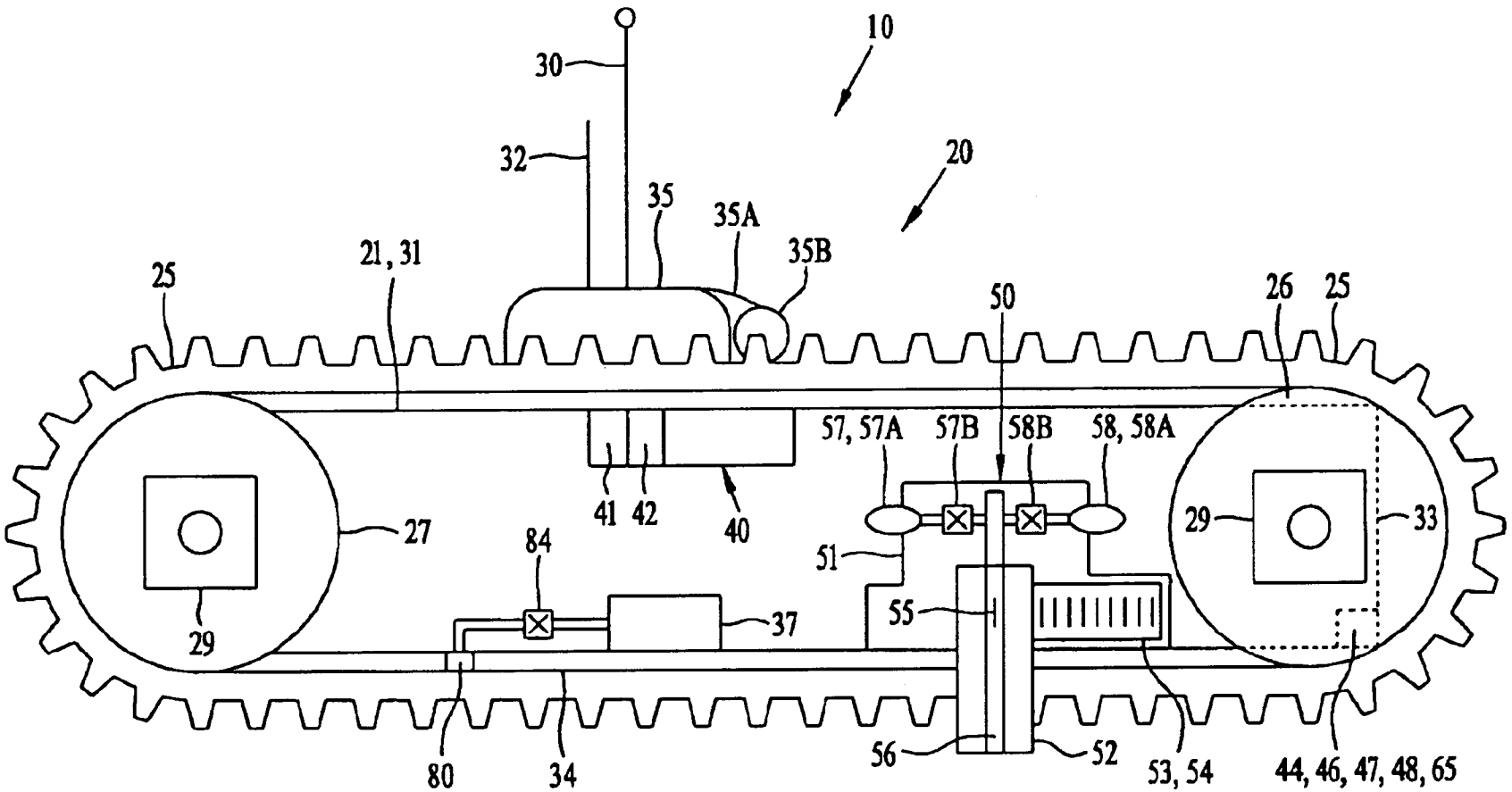
FIG. 3 is a cross-sectional schematic side view of the tracked crawler vehicle taken generally along line 3—3 in FIG. 1.

Referring to FIGS. 1, 2, and 3, an autonomous tracked system 10 of the invention is used to neutralize mines 5 in a mined area 5A on or beneath a topographical surface 6 of soil, sand, or marine sediment. Surface 6 can extend across land 7 such as a beach, and underwater 8 such as shallow water 8A outside of a shoreline 7A in a surf zone, and under deeper water 8B outside of the surf zone. Neutralization of mines 5 by system 10 is an essential step in conducting a successful amphibious assault to assure safe passage of personnel, materials, and vehicles.

Autonomous tracked system 10 is negatively buoyant to rest on or sink to surface 6. System 10 crawls along surface 6 from a remote station ST, (a manned surface or undersea craft or a land-based motor vehicle, for examples) at distant staging area SA. Autonomous tracked system 10 progresses to mined area 5A above or below surface 9 of water 8, searches for mines 5, and neutralizes them. This neutralization or disablement of mines 5 is accomplished by system 10 without exposing personnel or other more detectable and vulnerable high priority platforms to the dangers associated with this hazardous task.

A tracked crawler vehicle 20 of autonomous system 10 has an essentially box-shaped sealed watertight housing 21 provided with a pair of track assemblies 22 on opposite sides 23, 24. Housing 21 and other of the constituents of vehicle 20 are made from rugged and strong non-magnetic plastic-like materials such as the material marketed under the trademark LEXAN by General Electric Corporation of New York. Track assemblies 22 each has an endless track 25 wrapped about sprocket-like rollers 26, 27 at opposite ends of vehicle 20. A sealed shaft 28 extending from an electric or compressed gas powered motor 29 inside housing 21 is connected to each roller 26, 27 to tracks 25. Tracks 25 engage and crawl on surface 6 of soil, sand, or marine sediment to propel tracked crawler vehicle 20 in much the same manner as bulldozer-like earth moving vehicles do on dry land.

Motors 29 can be electric or pressurized gas driven or be a combination of these types of motors and have storage batteries 36 and/or at least one tank 37 of compressed gas in housing 21 to power motors 29 as they propel crawler vehicle 20 during a task. In addition an umbilical cable 38 can extend to a suitable source at a remote staging area (not shown) to deliver the necessary electrical and/or pressurized-gas power. While greater amounts of electrical and gas power can be provided from a remote source to sustain prolonged operations, umbilical cable 38 creates a drag on surface 6 that must be overcome by vehicle 20, and cable 38 could get tangled or hung-up as it is dragged along behind vehicle 20.

An antenna 30 for receiving global position system (GPS) signals extends upwardly from the top side 31 of housing 21. A float 35 can be released from top side 31 of vehicle 20 to buoy antenna 30 upward and away from vehicle 20 when tracked vehicle 20 goes beneath surface 9 of water 8. Antenna 30 is not submerged but remains extending above water 8. Vehicle 20 remains capable of receiving GPS signals, and the GPS signals continue to be relayed through an insulated, or sealed conductor 35A to a GPS signal processing section 41 of a control/communications module 40 in housing 21. Conductor 35A can be released from vehicle 20 to trail behind vehicle 20 or can be unreeled from a spring-biased spool 35B by the buoying, pulling force exerted by float 35. An advantage of using spring-biased spool 35B is that conductor 35A can be reeled in to avoid entanglement if and when vehicle 20 moves to shallower water.

Antenna 30 receives GPS signals and couples them to a GPS processing receiver section 41 in a control/communications module 40 in housing 21 to control the navigation of vehicle 20. GPS processing receiver section 41 can be any of many commercially available units that can be preprogrammed or preset to be responsive to GPS coordinate signals to "home in" on a remote location after the GPS coordinates of the remote location and destination waypoints are entered into it. Once the desired GPS coordinate signals of the designated area, or location are entered, the well-known combination of GPS antenna and receiver section 30, 41 sense and convert GPS signals coming from several satellites into signals representative of the location of autonomous tracked system 10. Responsive control signals are generated and conveyed to motor control unit 39 to correctly supply responsive amounts of power from batteries 36 to drive and steer autonomous tracked system 10 toward the designated remote mined location. The course system 10 takes does not need to be a straight line path from staging area SA to a mined location 5A but can be a round-about course identified by a series of GPS waypoints that lead eventually to mined area 5A. This round-about path of travel might be preferred to avoid not only known terrain features and other obstacles, but also the possibility that an adversary might back-track a straight-line course of vehicle 20 to find the undersea craft of remote station ST at staging area SA.

Motor control unit 39 is connected to batteries 36, gas source 37 and umbilical cable 38. In response to control signals from GPS processing receiver section 41 and computer 42 in control/communications module 40, motor control unit 39 connects responsive amounts of power for the proper duration from power sources 36, 37, 38 to motors 29 to control the speed and course crawler vehicle 20 of autonomous system 10 takes to mines 5. Motor control unit 39 can control motors 29 so that track assemblies 22 rotate both in the same direction to propel autonomous system 10 in the forward or reverse directions or rotate track assemblies 22 at different rates to steer vehicle 20.

Crawler vehicle 20 has control/communications module 40 powered by batteries 36 to control deployment of vehicle 20 from the staging area over-the-horizon to a location where mines are to be neutralized. GPS receiver section 41 along with computer 42 in control/communications module 40 has a software package running that is responsive to GPS signals to guide and control tracked vehicle 20 to an area mined or suspected of being mined. While autonomous system 10 is at staging area SA, or at an earlier time at a more remote base, an operator can enter data, including GPS coordinates of a distant possibly mined area 5A or specific mines 5, to designate where autonomous system 10 will be sent. In response to the entered data, the software in receiver section/computer 41, 42 generates appropriate motor control signals that are coupled to motor control unit 39. Motor control unit 39 connects power from power source 36, 37, 38 to motors 29 to drive tracks 25 and carry autonomous tracked system 10 to the designated area. Since GPS antenna 30 receives GPS signals representative of location en route, tracked crawler vehicle 20 can make responsive course corrections while underway to reach mined area 5A.

An acoustic transducer 44 can be located on front side 33 or bottom side 34 of housing 21 to acoustically locate mines 5 buried in soil, sand, and/or marine sediment when tracked crawler vehicle 20 arrives at mined area 5A. Some acoustic signals radiated from acoustic transducer 44 can penetrate soil, sand, and marine sediment beneath surface 6. The radiated, penetrating acoustic signals from acoustic transducer 44 can be phased or be lobe-shaped, and portions of the radiated penetrating acoustic signals are reflected from buried mine(s) 5. The reflected portions of the penetrating acoustic signals are received by acoustic transducer 44, and transducer 44 generates signals representative of the location of mine 5 and couples these mine location signals to computer 42. Computer 42 transforms the information of the mine location signals into motor control signals that are connected to motor control unit 39. Motor control unit 39 connects responsive amounts of power from power source 36, 37, 38 to motors 29 to drive tracks 25 and position autonomous tracked system 10 to align a gun mechanism 50 for firing penetrating rods 55 pointing at located mine 5.

A gun mechanism 50 is mounted in housing 21 and has a breech assembly 51 connected to a gun barrel 52 extending through bottom side 34 of housing 21 and aiming downwardly. A rotary or in-line magazine 53 of high-density dart-like penetrating rods 55 made, for example, of tungsten is connected to breech assembly 51. Magazine 53 has an electro-mechanical loading device 54 that operates to feed penetrating rods 55 from magazine 54 one-at-a-time into a chamber 56 in gun barrel 52 when computer 42 sends a load-and-lock control signal to loading device 54.

Chamber 56 extends from barrel 52 into breech assembly 51 and is connected to two pressurized reservoirs 57, 58 that each contains a different part 57A, 58A of a liquid bipropellant 59. Explosive liquid bipropellants 59 are well known and are created when two liquid parts, or compounds that are not explosive by themselves are mixed together. Two parts 57A, 58A that can create a suitable bipropellant 59 can be two liquid compounds of different relative concentrations of hydrogen peroxide and ammonium nitrate, for example, those known as 23 PERSOL 1 and OXSOL 1 although others could be selected.

Valves 57B, 58B are normally closed to keep parts 57A, 58A in reservoirs 57, 58, but when valves 57B, 58B are at least partially opened by activation signals from computer 42 of control/communications module 40, predetermined amounts of parts 57A, 58A are injected into chamber 56 from pressurized reservoirs 57, 58 where they mix in a turbulent swirling action into bipropellant 59. After valves are closed, a firing signal from computer 42 is sent to a sparkplug-like ignitor 60 in communication with chamber 56 to spark and detonate the mixed parts 57A, 58A of bipropellant 59. This detonation fires one of penetrating rods, or darts 55 from gun barrel 52 through surface 6 and through soil, sand, and/or marine sediment to penetrate into mine 5.

Consequently, mine 5 is neutralized since the fired penetrating rod 55 enables flooding of mine 5 with ambient water 8 or otherwise disrupts the firing or explosive train including detonators, detonating cord, and/or the electrical continuity of components of mine 5. This firing of penetrating rods 55 can be repeated by autonomous system 10 as many times as need be to neutralize mine 5 by rods 55. Targets other than mines 5, such as electronic instrumentation packages, hydrophones, etc., can be neutralized by penetrating rods 55 fired from gun 50.

By using a liquid propellant the need for projectile cases is eliminated to improve covertness since there are no expended cases lying about after a mission. Since the components, or parts 57A, 58A of liquid bipropellant 59 may not be classified as explosives, the safety of autonomous system 10 is improved, and storage and transportation will be less complicated. A variable propulsive charge of bipropellant 59 can be made by adjusting valves 57B, 58B to deliver a variable propellant charge by using the concept of the traveling charge, which is an explosive charge designed to follow a penetrator into a void and then detonate inside causing much greater damage. A variable propellant charge can effectively fire individual penetrating rods 55 from gun mechanism 50 to adjust for ambient water pressures and distances to mines 5 above and below surface 6. Bipropellant 59 is not corrosive to gun barrel 52, has low toxicity, and raw materials for parts 57A, 58A of bipropellant 59 are readily available in large quantities. Bipropellant 59 can be environmentally friendly, that is, it can be colored green.

Autonomous tracked system 10 of the invention is capable of making its way without further guidance by an operator to a targeted area. However, it is likely that system 10 could come across obstacles and terrain on land or undersea that might block progress and prevent successful completion of the mission. Accordingly, system 10 of the invention can receive assistance from an operator at remote station ST. An articulating video camera 46 on front or bottom sides 33, 34 of housing 21 can produce video signals representative of land and marine topography, including obstacles and features of interest, including mines 5 when they protrude above surface 6. The video signals are coupled to computer 42 of control/communications module 40 that has a software package running to process video signals from video camera 46 and transmit them via radio transceiver 45 and antenna 32 to a distant receiver at remote station ST. An operator at remote station ST can examine the information of the video signals and send remote control signals that are received by radio antenna 32 and transceiver 45 and fed to control/communications module 40. Control/communications module 40 generates appropriate control signals that are coupled to motor control unit 39. Motor control unit 39 connects power to motors 29 to drive tracks 25 and divert autonomous tracked system 10 around the obstacles and back on-track toward the designated mined area. A sealed lamp 47 near video camera 46 can illuminate the area near tracked vehicle 20 for clearer imaging by camera 46.

Optionally, acoustic transducer 44 can project some acoustic signals and receive reflected acoustic signals representative of marine topography, obstacles, and features of interest, including protruding mines 5 extending above surface 6. The information of the representative reflected signals is coupled to computer 42 of control/communications module 40 that has software responsive to acoustic signals to process them for transmission to a distant staging area. Transceiver 45 sends this information via antenna 32 to the operator at the staging area for appropriate action re steering and controlling vehicle 20 and/or for intelligence gathering purposes. Acoustic transducer 44 could also be used to communicate through water 8 to transmit acoustic information signals to the operator at the staging area and receive remotely originating acoustic control signals to maneuver and otherwise operate system 10 in addition to radio transceiver/antenna 45, 32.

Autonomous tracked system 10 can recover mines 5 or other objects of interest and place them in a receiver (not shown) on upper side 31 of housing 21. Mines 5 can first be neutralized with penetrating rods 55 or not; however, the recovery of armed ordnance can be very dangerous. An extensible/pivoted arm 70 having an articulating claw 72 and/or shovel blade 74 can be mounted on top side 31 of housing 21. Arm 70 can be controlled by control signals from control/communications module 40 to extend in front of and below vehicle 20 to dig-up or grasp mine 5 or other objects of interest. A second video camera 48 on front or bottom sides 33, 34 can provide additional video signals to help this recovery process. The additional video signals from video camera 48 can be transmitted back to the staging area by transceiver 45 with the other video signals from video camera 46 to create close up or stereoscopic imaging to allow more precise use of arm 70, claw 72, and shovel 74. Lamp 47 can help cameras 46 and 48 produce more revealing video signals. An operator at staging area can create and transmit control signals to transceiver 45 and control/communications module 40 to initiate appropriate movements of arm 70, claw 72, and shovel 74 for recovery.

Optionally, extensible arm 70 could be used to deliver an explosive charge (not shown) on a select target that might include mine 5. The explosive charge might be carried on top side 31, removed, and placed by arm 70, and later, the charge can be detonated after autonomous tracked system 10 has departed from the area.

A magnetic influence detector 65 can be located on front or bottom sides 33, 34 of housing 21 to magnetically locate mines 5 buried in soil, sand, and/or marine sediment when tracked crawler vehicle 20 arrives at mined area 5A. Signals representative of magnetic influence of mines 5 are generated by magnetic influence detector 65 and are coupled to computer 42. Computer 42 transforms the information of the mine influence signals into motor control signals that are connected to motor control unit 39. Motor control unit 39 connects responsive amounts of power from power source 36, 37, 38 to motors 29 to drive tracks 25 and position autonomous tracked system 10 to align and aim gun mechanism 50 for firing penetrating rods 55 at the magnetic mine 5. The information of the representative magnetic influence signals also can be processed in computer 42 for transmission to distant staging area SA via transceiver 45 for appropriate remote action by an operator if desired to steer and control vehicle 20 and/or for intelligence gathering.

Autonomous tracked system 10 of the invention is not intended to be destroyed in the neutralization process. After one mine is has been neutralized, system 10 can proceed onward to the next mine or return to its original staging area SA for reuse at a future time.

The remote control capability of system 10 can be responsive to, for example, electromagnetic control signals and/or acoustic control signals transmitted from yet another remote source (not shown) in addition to remote station ST to allow additional remote control. The necessary hardware and software for these additional communications capabilities can be included in control/communications module 40 including computer 42 to effectively interface with antennas 30, 32. The remote control capabilities can be desirable features when tactical scenarios change.

Tracked crawler vehicle 20 of autonomous tracked system 10 is dimensioned to carry sufficient batteries 36 or compressed gas 37 for round trip transit and for possibly carrying a recovered mine 5 back for gathering intelligence. Software entered into processing receiver/computer 41, 42 of control/communications module 40 enables generation of control signals to drive, steer and otherwise control tracked system 10 throughout a task, or mission. En route to the intended destination, corrections and/or changes in course can be made via electromagnetic control signals and/or acoustic control signals. These electromagnetic/acoustic control signals can be transmitted from undersea craft at the staging area SA, or another remote station ST to keep tracked system 10 on course or change as a tactical situation changes.

Figure 4:
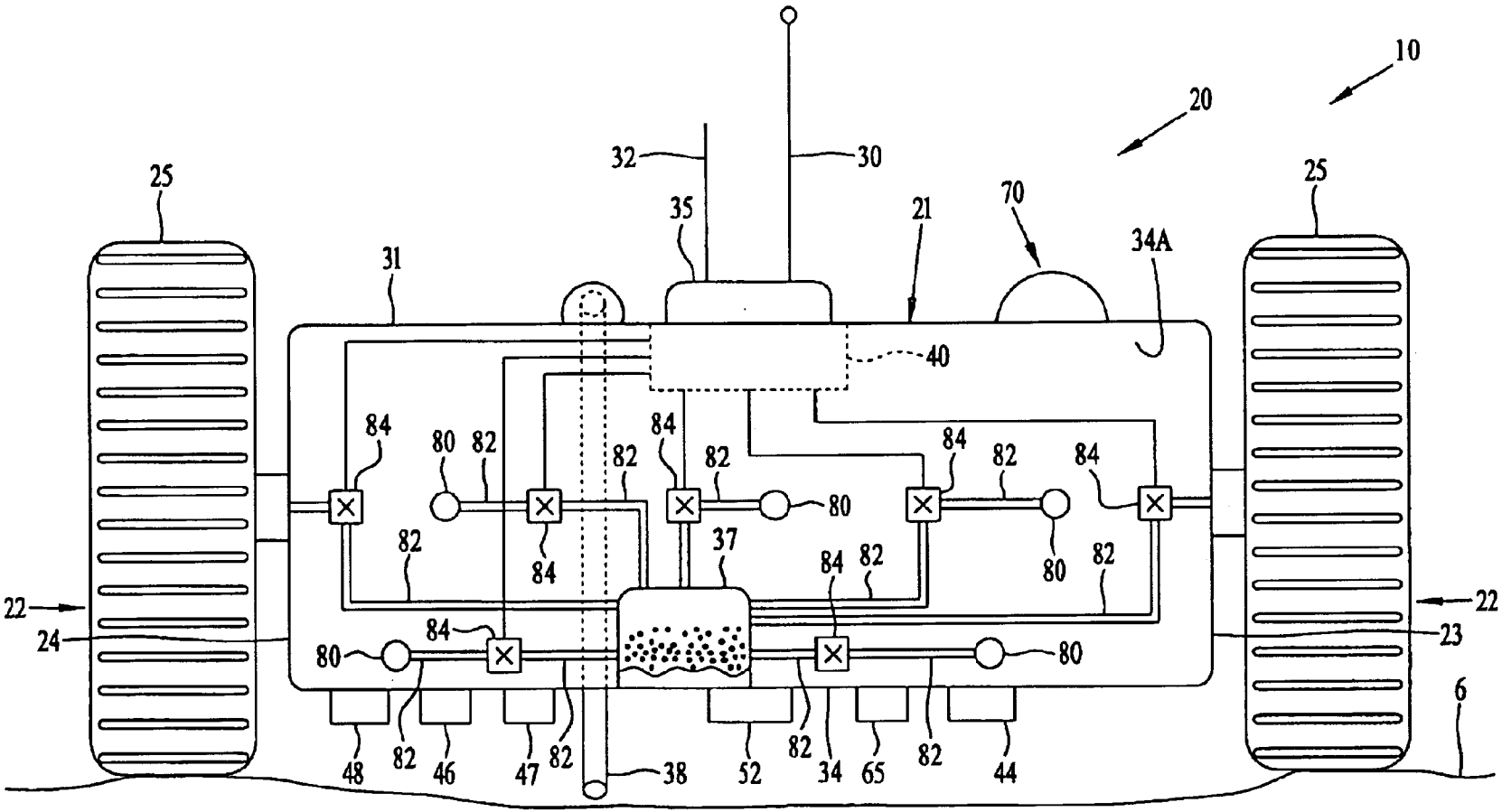
FIG. 4 is a schematic rear view of the tracked crawler vehicle showing some constituents of the autonomous system.

Referring in addition to FIG. 4, autonomous tracked system 10 additionally has a capability to free itself from being hemmed-in or hung-up by unforeseen trenches or other confining obstacles as it makes its way to mined area 5A. Nozzles 80 outwardly face from sides 23, 24, 31, 33, 34, and backside 34A of housing 21. Nozzles 80 are connected to high pressure feeder lines 82 connected to compressed gas tanks 37 (only one of which is schematically shown in FIG, 4) and umbilical cable 38 (as schematically represented by the dotted lines of umbilical cable 38 crossing lines 82). Feeder lines 82 each have a valve 84 (only a few lines 82 and valves 84 are shown) connected to control/communications module 40, and selected ones of valves 84 along one or more of the sides of vehicle 20 can be opened by control signals from module 40 to discharge volumes of pressurized gas through predetermined ones of nozzles 80. The discharged volumes of pressurized gas not only blow soil, sand, and marine sediment away but can also create a recoil-like reaction displacement of autonomous system 10 in the opposite direction of discharged volumes. The combination of the blown-away material and the recoil displacement, along with rotation of track assemblies 22 can extricate autonomous system 10 from what would otherwise be an impasse. Venting gas through selective ones of nozzles 80 could also be used to propel and steer vehicle 20 en route to a designated area.

Autonomous tracked system 10 is capable of successfully navigating a path on surface 6 from deep water through shallow water, through shallower water in the surf zone, and onto land 7 such as a beach. Mines 5 can be located and neutralized throughout this path. Components and connections for control/communications module 40 including receiver section/computer 41, 42 and their appropriate interconnection to responsive machinery including motor control unit 39 as described above are well known in the art. Considerable numbers of off-the-shelf units have long been available for model aircraft and boats, unmanned reconnaissance and drone craft, and full-scale marine and aircraft systems. These applications routinely rely on interfacing with numerous navigational aids, such as GPS, other electromagnetic and acoustic signals to steer a given course to a preset destination. Therefore, having this disclosure before him, one skilled in the art to which this invention pertains is free to choose and appropriately interconnect suitable components freely available in the art.

Tracked system 10 of the invention is a covert and fully autonomous means of neutralizing mines 5 in a designated area and is capable of being safely deployed from over-the-horizon and keeping personnel away from danger. Firing of penetrating rods 55 can go virtually undetected, particularly when compared to detonation of explosive line charges. After mines 5 in an area or lane have been neutralized, system 10 can surreptitiously withdraw to its deployment area via GPS guidance. Unlike contemporary explosive clearing systems, autonomous system 10 could retrieve one or more mines 5 for laboratory analysis.

Autonomous tracked system 10 of the invention does not place personnel in harms way, and location and neutralization of mines 5 are completed in a single operation, saving time, and resources. Mines 5 are not exploded by system 10 to allow them to be recovered for intelligence use, and because of the covertness of neutralization of mines 5 by system 10 secrecy can be maintained by assaulting forces to keep undisclosed the actual location of a breaching operation. By using system 10 to neutralize and not detonate mines 5 close to assets such as ships and pier facilities, these assets are not destroyed but are preserved for use by assaulting forces. Since no craters are formed when system 10 neutralizes mines on land or in very shallow water, the maneuverability of the assaulting forces is not hindered.

Having the teachings of this invention in mind, modifications and alternate embodiments of autonomous tracked system 10 may be adapted without departing from the scope of the invention. Its uncomplicated, compact design incorporates structures and technologies long proven to operate successfully in hostile land and marine environments associated with mine neutralization operations. Autonomous system 10 lends itself to numerous modifications to permit its reliable use in different ways for different purposes in hostile and demanding environments both on open water, surf zones, and over many different types of land mass, including but not limited to beaches, hard-pack, soft mud, marsh, tidal flats etc. Autonomous system 10 of the invention can be made larger or smaller in different shapes and fabricated from a wide variety of materials to assure resistance to corrosion, sufficient strength for heavy loads, and long-term reliable operation under a multitude of different operational requirements. Autonomous system 10 of the invention can be made to use cased ammunition; a heavy weight gun barrel might be used to allow for larger ammunition; penetrating rods 55 of high density materials could be selected instead of tungsten; shaped charges from 10 mm to 5 inches in diameter could be shot thru gun barrel 52; a drill could be relied on instead of or in addition to extensible gun mechanism 50 and arm 70 to penetrate mines 5 and flood the explosives and/or electronics; and ballast tanks or weights (not shown) may be added to help create more positive traction, although too much weight might cause system 10 to detonate some mines 5 that are sensitive to heavier targets.

The disclosed components and their arrangements as disclosed herein, all contribute to the novel features of this invention. Autonomous tracked system 10 assures neutralization mines 5 packages irrespective of ambient conditions and terrain. Therefore, autonomous system 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. A system for autonomous neutralization of mines comprising:

a tracked crawler vehicle having a sealed housing, power source, and motor driven track assemblies on opposite sides of said housing;

a control/communications module in said housing having a GPS processing receiver section connected to a GPS antenna extending upwardly to receive GPS signals and generate first control signals;

an acoustic transducer generating signals representative of acoustic location of a mine;

a gun mechanism in said housing being connected to said control/communications module, said gun mechanism having a gun barrel extending and aiming downwardly through a bottom side of said housing toward a surface beneath said housing; and penetrating rods in said gun mechanism to be fired through said gun barrel for penetrating said surface and a mine.

2. The system of claim 1 further comprising:

a computer in said control/communications module receiving said mine acoustic location signals to generate second control signals.

3. The system of claim 2 wherein said gun mechanism has bipropellant injected into a chamber to fire each of said penetrating rods through said surface and into said mine for neutralization thereof, and said motor driven track assemblies each have a motor connected to said power source and each have an endless track on rollers for engaging extensions of said surface to propel and steer said tracked crawler vehicle.

4. The system of claim 3 further comprising:

a float connected to support said GPS antenna, said float being releasable from said housing to receive GPS signals on said GPS antenna during submergence of said tracked crawler vehicle; and a conductor extending from said GPS antenna to said control/communications module.

5. The system of claim 4 further comprising:

a motor control unit connected to said control/communications module to receive said first and second control signals and connect responsive amounts of power from said power source to said motors, said acoustic transducer being mounted on said housing and connected to said control/communications module, said acoustic transducer radiating acoustic signals penetrating beneath said surface, portions of said penetrating acoustic signals being reflected from said mine as said mine location signals.

6. The system of claim 5 wherein said mine acoustic location signals are representative of the location of said mine beneath said surface.

7. The system of claim 6 wherein said acoustic transducer projects acoustic signals and receives reflected acoustic signals of said projected acoustic signals representative of marine topography and mines protruding above said surface.

8. The system of claim 7 further comprising:

a first video camera on said housing to provide first video signals representative of land and marine topography and features of interest;

a light source for illuminating an area near said tracked vehicle and a transceiver in said housing having a radio antenna on said float, said transceiver transmitting the information of said acoustic signals and said first video signals to a distant staging area and receiving responsive remote control signals from said staging area.

9. The system of claim 8 further comprising:

a second video camera on said housing to provide second video signals representative of land and marine topography and features of interest, said second video signals being transmitted by said transceiver to said staging area.

10. The system of claim 9 further comprising:

a plurality of nozzles on sides of said housing to discharge volumes of pressurized gas from said power source through selected ones of said nozzles, said discharged volumes of gas creating displacement said tracked vehicle in the opposite direction of said discharged volumes.

11. The system of claim 10 wherein said gun mechanism has parts of said bipropellant injected from reservoirs into said chamber, mixed in a turbulent, swirling action in said chamber and detonated by a sparkplug-like ignitor in said chamber to fire said penetrating rod from said gun barrel through said surface to penetrate into said mine.

12. The system of claim 11 wherein said penetration into said mine by said penetrating rod thereby neutralizes said mine by enabling flooding of said mine with ambient water and disrupting the firing train of said mine.

13. The system of claim 2 further comprising:

a magnetic influence detector generating signals magnetic influence signals representative of location of a mine, said computer in said control/communications module receiving said magnetic influence signals to generate control signals.

14. A method of autonomously neutralizing mines comprising the steps of:

generating first control signals from GPS signals on a GPS antenna coupled to a GPS processing receiver section of a control/communications module in a tracked crawler vehicle having a sealed housing, power source, and motors driving track assemblies on opposite sides of said housing;

generating second control signals in a computer of said control/communications module, said second control signals being generated from acoustic signals received at an acoustic transducer on said tracked crawler vehicle;

connecting responsive amounts of power from said power source to said motors with a motor control unit connected to receive said first and second control signals from said control/communications module; and steering and propelling said tracked crawler vehicle by said first control signals from said control/communications module;

locating a mine beneath a topographical surface with acoustic signals penetrating beneath said surface;

maneuvering said tracked crawler vehicle to aim a gun barrel of a gun mechanism extending through a bottom side of said housing toward said surface and said mine;

firing at least one penetrating rod from said gun mechanism through said gun barrel;

penetrating said surface and said mine with said penetrating rod; and neutralizing said mine.

15. The method of claim 14 wherein said step of locating a mine comprises the steps of:

radiating acoustic signals from said acoustic transducer on said tracked crawler vehicle for creating said acoustic signals penetrating beneath said surface;

reflecting back portions of said penetrating acoustic signals from said mine to said acoustic transducer; and generating signals in said acoustic transducer representative of the location of said mine.

16. The method of claim 15 wherein said step of neutralizing said mine comprises the steps of:

flooding said penetrated mine with ambient water; and disrupting the firing train of said mine.

17. The method of claim 16 wherein said step of firing comprises the steps of:

injecting parts of a bipropellant into a chamber of said gun mechanism;

mixing said parts of said bipropellant in said chamber and igniting said mixed parts of said bipropellant in said chamber.

18. The method of claim 17 wherein said step of generating from GPS signals further comprises the step of:

floating said GPS antenna having a conductor extending to said control/communications module from a float releasable from said housing to receive GPS signals on said GPS antenna during submergence of said tracked crawler vehicle.

19. The method of claim 18 further comprising the steps of:

projecting acoustic signals from said acoustic transducer;

receiving reflected acoustic signals of said projected acoustic signals representative of marine topography and mines protruding above said surface.

20. The method of claim 19 further comprising the steps of:

providing first video signals on a first video camera on said housing being representative of land and marine topography and features of interest; and transmitting the information of said acoustic signals and said first video signals with a radio transceiver to a distant staging area; and receiving remote control signals responsive to said acoustic signals and said video signals from said staging area.

21. The method of claim 20 further comprising the steps of:

providing second video signals with a second video camera on said housing representative of land and marine topography and features of interest, said second video signals being transmitted by said transceiver to said staging area; and illuminating an area near said tracked vehicle.

22. The method of claim 21 further comprising the steps of:

discharging volumes of pressurized gas from said power source through selected nozzles; and displacing said tracked vehicle with said discharged volumes of pressurized gas in a direction opposite to the direction of said discharging.

23. The method of claim 14 further comprising the steps of:

generating control signals from a magnetic influence detector in said computer of said control/communications module.

* * * * *